US005467979A

United States Patent [19]

Zarate

[11] Patent Number: 5,467,979

[45] Date of Patent: Nov. 21, 1995

[54] BASEBALL BATTING PRACTICE DEVICE

[76] Inventor: Rene A. Zarate, 813 Madison, Alice, Tex. 78332

[21] Appl. No.: 109,999

[22] Filed: Aug. 23, 1993

[51] Int. Cl.[6] ..... A63B 69/40

[52] U.S. Cl. ..... 273/26 R; 273/29

[58] Field of Search ..... 273/29 A, 26 E, 273/26 EA, 185 C, 184 B, 196, 193 B, 197 A, 198, 200 A, 319, 321, 331, 334, 335, 369, 370, 390, 391, 392, 367, 368, 369, 375, 376, 407, 127 D

[56] References Cited

U.S. PATENT DOCUMENTS

| | | | |
|---|---|---|---|
| 518,931 | 4/1894 | Allen | 273/369 |
| 3,430,959 | 3/1969 | Ross et al. | 273/127 D |
| 3,472,075 | 10/1969 | Oppenheimer | 273/185 C |
| 4,092,023 | 5/1979 | Hazen | 273/369 |
| 4,216,960 | 8/1980 | Nichollis | 273/29 A |
| 4,588,194 | 5/1986 | Steidle | 273/391 |
| 5,176,386 | 1/1993 | Simmons | 273/392 |
| 5,181,721 | 1/1993 | Halliburton | 273/390 |

*Primary Examiner*—Theatrice Brown
*Attorney, Agent, or Firm*—G. Turner Moller

[57] ABSTRACT

A baseball bating practice device includes a frame having a pair of spaced supports mounting a rod for rotation about an axis perpendicular to the supports. A baseball target is positioned on one or both ends of the rod. Resilient straps connect the rod to the supports and allow the rod to rotate freely about the axis. Additional resilient straps may be attached to the rod at a location spaced from the axis to retard rotation of the strap. The frame may be positioned so the rod rotates about a horizontal axis or about a vertical axis.

12 Claims, 3 Drawing Sheets

BASEBALL BATTING PRACTICE DEVICE

This invention relates to a baseball batting practice device and more particularly to a device which suspends a ball on a frame by a plurality of resilient straps.

Baseball batting practice devices of various type are well known in the art. The simplest type is known as a T-ball which is basically an upstanding resilient support on which a baseball is placed. The batter simply swings at it. At the other end of a range of cost, complexity and reality is a pitching machine which throws baseballs toward the plate and the batter swings at them as they go past.

A number of baseball batting practice devices are of intermediate cost and complexity. One of these types suspends a ball between supports by use of a more-or-less elastic tensile member. When the batter hits the ball, it oscillates around its rest position and the batter swings again. Devices of this general type are shown in U.S. Pat. Nos. 1,554,409; 3,475,026; 4,966,367; 5,040,791 and 5,072,937. It is this type device to which this invention most nearly relates.

There are a variety of problems or disadvantages of the prior art devices of this type. In their simplest form, they are not much different than a T-ball support because the batter simply swings at it. They have an advantage over a T-ball because the ball ultimately returns to the hitting position rather than having to be retrieved. Only one of these prior art devices has the ability to adjust the position of the ball or contribute to the development of hand-eye coordination caused by movement of the ball immediately prior to or during the hitting stroke. In addition, few of the prior art devices have the capability of adjusting the device so the ball reacts differently after being hit, i.e. the device is capable of presenting the ball in different modes for the next hit.

It is an object of this invention to provide an improved baseball batting practice device having a baseball target mounted on the end of a rod and means mounting the rod for rotation about an axis spaced from the target.

Another object of this invention is to provide an improved baseball batting practice device having a baseball target mounted on a rod for rotation about a horizontal axis.

A further object of this invention is to provide an improved baseball batting practice device having a baseball target mounted on a rod for rotation about an axis and means for controlling the rate of rotation.

These and other objects of this invention will become more fully apparent as this description proceeds, reference being made to the accompanying drawings and appended claims.

IN THE DRAWINGS

Figure 1:
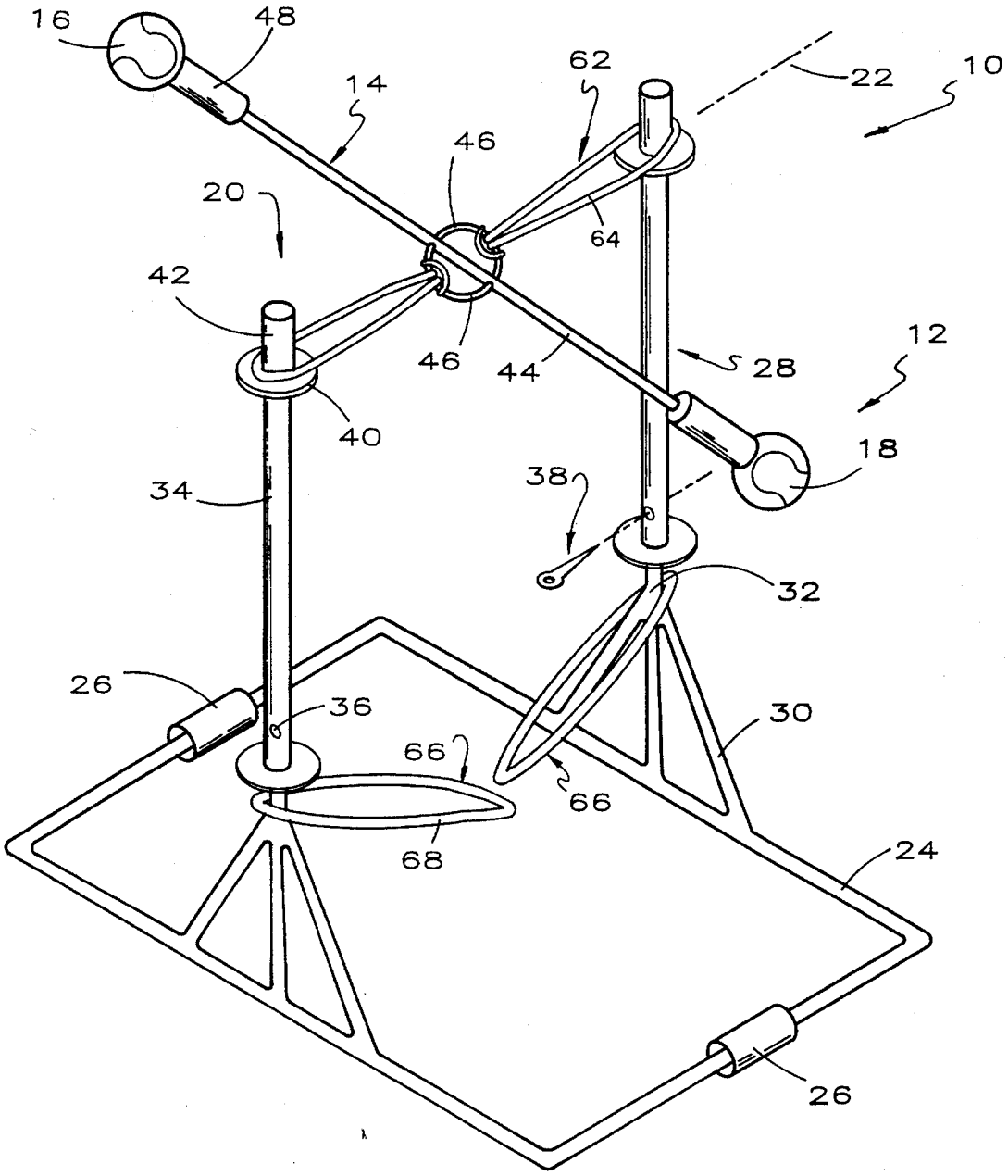
FIG. 1 is an isometric view of one embodiment of this invention, illustrating one arrangement for controlling the rebound of the target.
Figure 2:
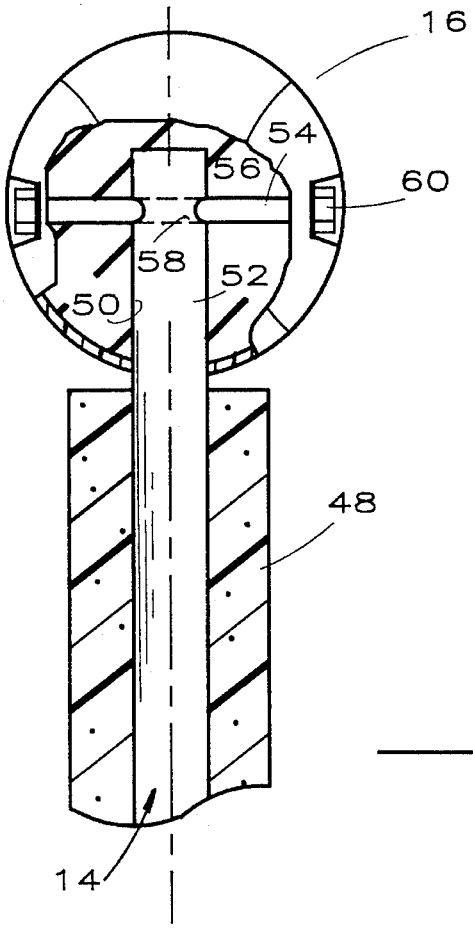
FIG. 2 is an enlarged front view of the connection between the rod and the baseball target.
Figure 3:
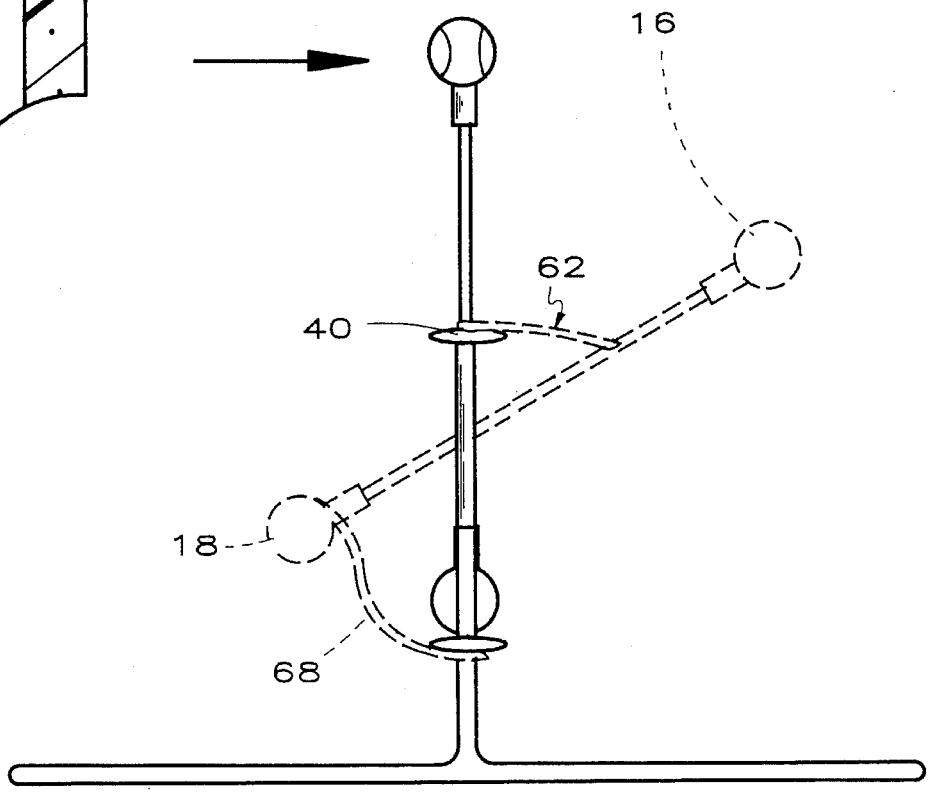
FIG. 3 is a view similar to FIG. 1, illustrating another arrangement for controlling the rebound of the target.

Referring to FIGS. 1–3, a baseball batting practice device 10 of this invention comprises, as major components, a frame 12, a rod 14 having one or more baseball targets 16, 18 thereon and means 20 mounting the rod 14 for rotation about a horizontal axis 22.

The frame 12 is of flat rectangular shape and is made of thin walled pipe or solid rod 24 bent to shape and connected by couplings 26. A pair of parallel upright supports 28 are provided on each side of the frame 12. The supports 28 include a base 30 welded to the pipe 24 having a central rod 32 providing a plurality of openings (not shown) therethrough and a telescopingly adjustable pipe section 34 having an opening 36 therein. The pipe sections 34 are vertically slidably mounted on the rods 32 and are releasably connected to the central rod 32 in any suitable manner, as by the use of a removable pin 38 extending through the openings 36 and through comparable openings in the rod 32. It is accordingly seen that the height of the rod 14 and thus the height of the ball 16 may be adjusted to accommodate players of different height. The upper end of the pipe sections 34 include a washer like enlargement or shoulder 40 providing an upwardly extending rod 42.

The rod 14 includes a straight central shank 44 having a pair of oppositely extending D-rings or hooks 46 in a central region of the shank 44. The baseball targets 16, 18 are connected to the rod 14 in any suitable manner. As shown in FIG. 2, a rubber sleeve or shock absorber 48 covers the upper end of the rod 14 to protect the device 10 and the user when the bat strikes the rod 14. A baseball or target 16 provides a blind opening 50 receiving the top of the rod end 52. The interior of the ball 16 may be of conventional baseball construction or may be a hard rubber like material as shown. A pin 54 extends snugly through a passage 56 in the ball 16 and through an opening 58 in the rod end 52. A pair of screws 60 thread into the ends of the pin 54, compress the outside of the ball 16 slightly to recess the end of the screw 60 and captivate the ball 16 to the pin 54 and thereby to the rod end 52. The ball target 18 is attached to the opposite end of the rod 14 in a similar fashion.

The mounting means 20 comprises one or more rubber straps 62 connecting the rod 14 to the supports 28. Preferably, the rubber straps 62 comprise an O-ring 64 having one end looped about the ring 46 and the other end extending over the rod 42. It will accordingly be seen that the rod 14 is resiliently mounted for rotation about the axis 22.

In use, the frame 12 is prevented from moving by placing it against an abutment, such as a wall, or staking it to the ground. When a batter strikes the ball target 16, the rod 14 rotates about the axis 22 and the axis 22 oscillates relative to the supports 28. This winds up the resilient straps 62 which decelerate the rod 14 until it stops and begins rotating in the opposite direction. The ball 16 may be struck again while it is rotating or when it stops. It will be seen that the second ball target 18 makes the rod 14 symmetrical so it rotates in an even manner and either target 16, 18 may be struck when the rod 14 is rotating. The ball target 18 also provides a replacement when the ball 16 become out of shape simply by disconnecting the rubber straps 62 and repositioning the rod 14.

Referring to FIG. 3, another feature of the device 10 is illustrated. Relying solely on the straps 62 to absorb the force of striking the target 16 and stopping the rod 14 from rotating can be too slow in some circumstances. Accordingly, it is often desirable to arrange the device 10 so the rod 14 rapidly returns to its at rest position to be ready for the next hit. To this end, a second pair of rubber straps 66 may be provided to connect the rod 14 to the frame 12 at a location spaced from the axis 22. As shown in FIG. 1 and 3, the straps 66 may comprise an O-ring 68 slipped over the support 28 and slipped over the end of the lower ball target 18.

When the target 16 is struck in the configuration of FIG.

3, the rod 14 reacts in a manner different than if the straps 66 are not in place. Rather than the majority of motion being rotation about the axis 22, the bulk of the motion is an oscillation of the axis 22 because the rod 14 does not rotate much more than the inclination shown in dashed lines in FIG. 3. Thus, the rod 14 reacts against the strike of the bat and inclines relative to the supports 48. The exact angle is a function of how hard the target ball 16 is struck and the strength of the straps 62, 66 but the angle can be in the neighborhood of about 30° relative to the ground surface.

Figure 4:
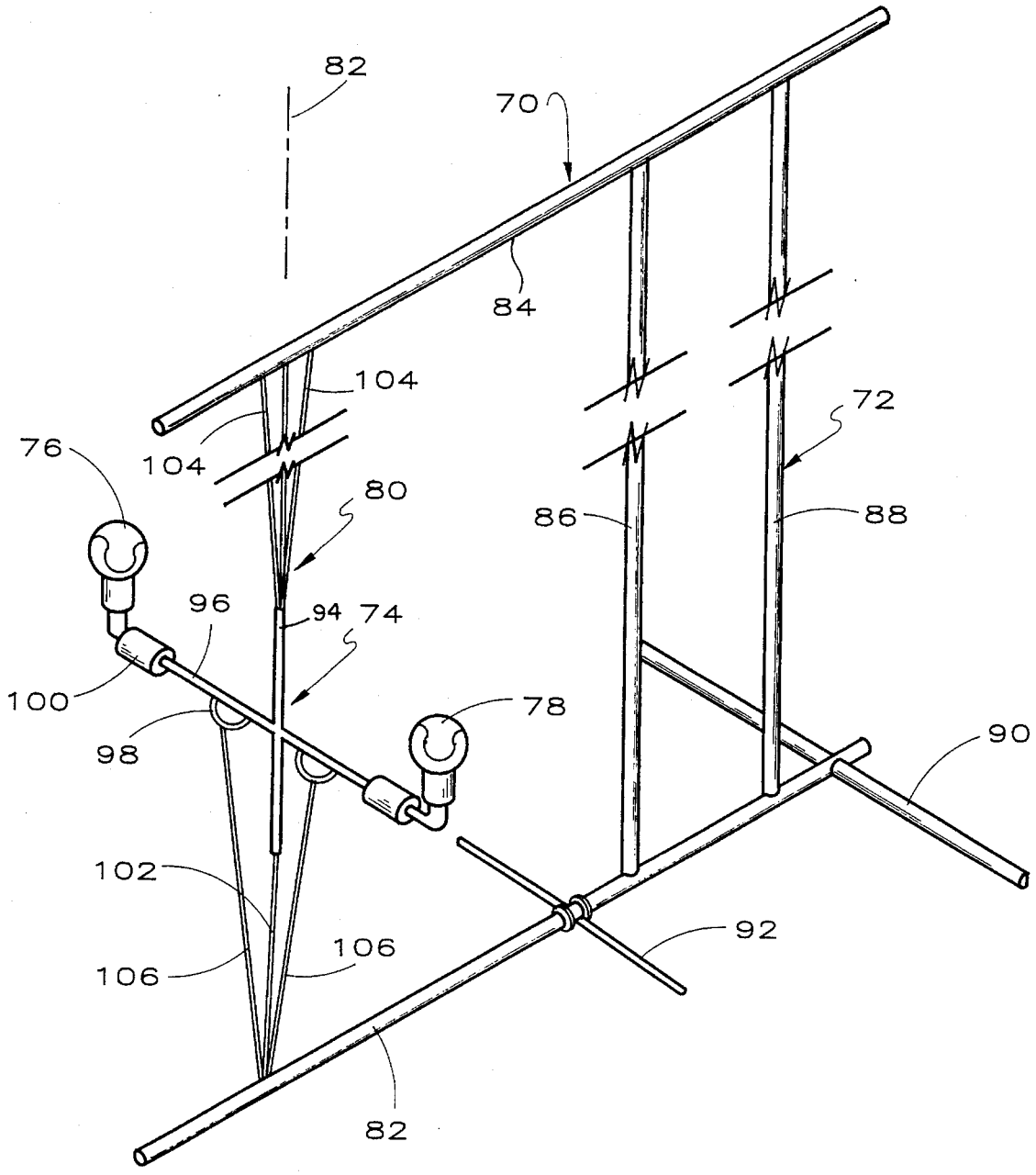
FIG. 4 is an isometric view of another embodiment of this invention.

This invention is also applicable to baseball batting practice devices where the rod rotates about a vertical axis. As shown in FIG. 4, a batting practice device 70 comprises, as major components, a frame 72, a cross-shaped target carrier 74 having one or more baseball targets 76, 78 thereon and means 80 mounting the carrier 74 for rotation about a vertical axis 82.

The frame 72 is of a type shown in U.S. Pat. No. 5,072,937, the disclosure of which is incorporated herein by reference. The frame 72 includes a pair of horizontal pipe sections 82, 84 supported by a pair of vertical pipe sections 86, 88. A pair of foot pieces 90 provide lateral stability.

The carrier 74 includes a vertical shank 94 lying along the axis 82 and a horizontal shank 96 perpendicular to the shank 94. A downwardly facing D-ring 98 is provided on each side of the shank 96 as will be more fully apparent hereinafter. The baseball targets 76, 78 are mounted on upturned ends of the shank 96 in the manner shown in FIG. 2. One or more shock absorbing foam sleeves 100 may be provided adjacent the outer ends of the shank 96.

The mounting means 80 includes a resilient strap 102 connecting the lower end of the vertical shank 94 to the horizontal frame member 82 while one or more resilient straps 104 connect the upper end of the shank 94 to the upper horizontal frame member 84. As described, the baseball batting practice device 70 works much like the device 10 because striking the either of the ball targets 76, 78 causes the carrier 74 to rotate about the vertical axis 82 thereby winding up the resilient straps 102, 104 and slowly decelerating the carrier 74. It will be apparent that the straps 102,104,106 may be O-ring type members or single length members.

If it is desired to slow down the rotation of the carrier 74, a pair of additional resilient straps 106 are connected between the D-rings 98 and the lower horizontal support 82. This changes the reaction of the carrier 74 and shortly returns it to the at rest position in much the same manner that the straps 66 change the reaction of the rod 14.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A baseball batting practice device comprising a frame providing first and second spaced supports;

a rod having a ball on at least one end thereof; and means mounting the rod on the supports for arcuate movement about a plurality of closely spaced axes spaced from the ball, the mounting means including a first resilient member fixed to the rod intermediate the ends thereof and attached to the first support and a second resilient member fixed to the rod intermediate the ends thereof and attached to the second support, rotation of the rod about the said axis acting to twist the first and second resilient members upon said at least one ball being hit by a batter.

2. The baseball batting practice device of claim 1 wherein each of the resilient members comprises a continuous loop.

3. The baseball batting practice device of claim 2 wherein the supports each comprise a rod having an enlargement adjacent one end thereof, said continuous loop extending around the rod between the end of said rod and said enlargement.

4. The baseball batting practice device of claim 2 wherein the rod comprises an elongated member and a pair of loops intermediate the ends thereof at a location corresponding to said axes, said continuous loops extending through the loops.

5. The baseball batting practice device of claim 1 further comprising a third resilient member connected to the first support and to the rod at a location spaced from said axes and a fourth resilient member connected to the second support and to the rod at a location spaced from said axes.

6. The baseball batting practice device of claim 1 further comprising a ball on each end of the rod, the balls being rigidly fixed to the rod.

7. The baseball batting practice device of claim 6 wherein the rod is essentially straight.

8. The baseball batting practice device of claim 1 wherein the axes of rotation are substantially horizontal.

9. The baseball batting practice device of claim 1 wherein the supports comprise a first section rigid with the base, a second section and means telescoping the second section relative to the first section.

10. The baseball batting practice device of claim 1 wherein striking of said at least one ball cause said resilient members to be twisted in a first direction and energy stored in said resilient members as a result of said twisting cause said rod to be rotated about said axes in a second opposite direction and causes rotation of the rod in a second direction, opposite to the first direction.

11. The baseball batting practice device of claim 10 wherein said at least one ball is rigidly fixed to the rod.

12. A baseball batting practice device comprising a frame providing first and second spaced supports;

a rod having a ball on each end thereof; and means mounting the rod on the supports for rotation about a plurality of closely spaced axes spaced from said balls, said mounting means including a first resilient member fixed to the rod intermediate the ends thereof and attached to the first support and a second resilient member fixed to the rod intermediate the ends thereof and attached to the second support, rotation of the rod about the axes acting to twist the first and second resilient members whereby a batter may strike either of the balls for rotation about said axes.

* * * * *